US005292389A

United States Patent [19]

Tsuji et al.

[11] Patent Number: 5,292,389

[45] Date of Patent: Mar. 8, 1994

[54] PROCESS FOR PRODUCING NONWOVEN FABRIC

[75] Inventors: Issei Tsuji, Chiba; Hideki Harada; Masato Doi, both of Himeji, all of Japan

[73] Assignee: Idemitsu Petrochemical Co., Ltd., Tokyo, Japan

[21] Appl. No.: 847,649

[22] Filed: Mar. 6, 1992

[30] Foreign Application Priority Data

Mar. 12, 1991 [JP] Japan ..... 3-73968

[51] Int. Cl.[5] ..... D04H 3/14; D04H 3/00

[52] U.S. Cl. ..... 156/167; 156/161; 156/181; 156/229; 156/296; 264/288.8

[58] Field of Search ..... 156/181, 161, 229, 290, 156/296, 308.4, 167, 209, 166; 26/51; 264/288.8

[56] References Cited

U.S. PATENT DOCUMENTS 3,855,045 12/1974 Brock ..... 156/290 X
3,855,046 12/1974 Hansen et al. ..... 156/290 X
3,949,128 4/1976 Ostermeier ..... 156/229 X
4,048,364 9/1977 Harding et al. ..... 156/244.21 X
4,223,059 9/1980 Schwarz ..... 264/288.8 X
4,269,888 5/1981 Ejima et al. .
4,443,513 4/1984 Meitner et al. .

FOREIGN PATENT DOCUMENTS 0127483 12/1984 European Pat. Off. .
0244821 11/1987 European Pat. Off. .
0314581 5/1989 European Pat. Off. .

*Primary Examiner*—Jeff H. Aftergut
*Attorney, Agent, or Firm*—Flynn, Thiel, Boutell & Tanis

[57] ABSTRACT

A process for producing a nonwoven fabric having the steps of: bonding polypropylene long-fibers constituting main fibers of the web to one another to produce a raw nonwoven fabric; and uniaxially drawing the raw nonwoven fabric at certain draw temperatures and draw magnifications to produce a final nonwoven fabric.

11 Claims, No Drawings

PROCESS FOR PRODUCING NONWOVEN FABRIC

BACKGROUND OF THE INVENTION

1. Field of the Invention

The present invention relates to a process for producing a nonwoven fabric.

2. Description of the Related Art

Recently, there have been increased the kinds of machined production, such as bags and diapers, as products of nonwoven fabric. Accordingly, the machinability of a nonwoven fabric needed to be improved in order to increase the productivity of such products of nonwoven fabric. When speeds of processing machines for products of nonwoven fabric are increased, a tension in a nonwoven fabric must be increased so that the nonwoven fabric can stably run. However, when a high tension is applied to a poorly machinable nonwoven fabric, the nonwoven fabric has an increased elongation, so that the running nonwoven fabric largely fluctuates and operations of the processing machines are unstable. Accordingly, properties of products of such poorly machinable nonwoven fabric are poor.

Conventionally, 1) a method of strongly drawing a thread during spinning and 2) a method of arranging more threads in the direction of the flow of a nonwoven fabric than in the transverse direction during the spreading of fibers are employed in order to increase the fiber strength of the nonwoven fabric in the direction of the flow (hereinafter referred to as MD direction) relating to the machinability of the nonwoven fabric.

In the method of 1), thread breakage can occur during drawing. In addition, since a high fusion temperature is required when a web produced by the method of 1) is thermally embossed to the nonwoven fabric, a production speed of the nonwoven fabric must be reduced for the complete fusion of the web and, on the other hand, the fusion of the web must be incomplete so that the high-speed production of a nonwoven fabric is maintained.

The method of 2) has a drawback in that the productivity of the method is poor since the mechanical structure for achieving the method is complicated.

On the other hand, there have been proposed a process in which a web made of continuous long-fibers is drawn in the direction of the flow of the web to produce a high-strength nonwoven fabric (see Japanese unexamined patent application publication HEI.1-321962) and a process for improving the dimensional stability of a nonwoven web comprising the steps of entangling filaments of the nonwoven web by means of a liquid flow and subsequently drawing the nonwoven web in a predetermined range in at least one direction (see Japanese unexamined patent application publication SHO.59-204960).

In the process of Japanese unexamined patent application publication HEI.1-321962, a problem that the nonwoven fabric winds about a roller may occur since the drawing temperature is high.

In the process of Japanese unexamined patent application publication SHO.59-204960, there is a problem in that the productivity is poor since the step of entangling filaments by means of the liquid flow is required.

An object of the present invention is to provide a process for producing a nonwoven fabric of a superior machinability.

SUMMARY OF THE INVENTION

A process for producing a nonwoven fabric of the present invention is characterized in that it comprises the steps of: bonding polypropylene long-fibers constituting main fibers of the web to one another at an index of birefrigence of 0.02 or less to produce a raw nonwoven fabric; and uniaxially drawing the raw nonwoven fabric and a draw temperature of 80°–130° C. at a draw magnification of 1.5–2.5 to produce a final nonwoven fabric.

Materials for the polypropylene long-fibers preferably comprise homopolypropylene and random copolymers of propylene and α-olefin (e.g., ethylene). In addition, each of these materials may includes a slight volume of an added different polymer such as polyester, polyamide, and/or polycarbonate. In addition, the material may include previously mixed additives such as a flame retardant, a pigment, an antistatic agent and/or a weather resistance increasing agent if required.

The molecular weight of a material of polypropylene is optional.

The thread diameter of the long-fiber is preferably 10–100 μm. When the thread diameter is less than 10 μm, a thread tends to break. On the other hand, when it is more than 100 μm, the feeling of a nonwoven fabric is hard.

A web made of polypropylene long-fibers as a main material may include a different kind of fiber. For example, it can include fibers of a polyolefin such as polyethylene, fibers of a polyester such as PET, polyamide fibers and/or rayon fibers.

Alternatively, fusing a web produces a nonwoven fabric by the process for producing a nonwoven fabric according to the present invention. The fusion method for changing a web into a nonwoven fabric is not restricted. For example, thermal embossing using an embossing roller is suitable. In this case, the embossing temperature preferably is 120°–150° C. When it is lower than 120° C., the fusion of the web is insufficient and the nonwoven fabric tends to nap and/or ravel. On the other hand, when it is higher than 150° C., the feeling of a nonwoven fabric may degrade due to holes in fused areas in the final nonwoven fabric and the fusion of fibers of the edges of the holes.

The compression percentage in the fusion of the web is optional, but preferably from 3–20%. When it is less than 3%, fibers of the web may slip off. On the other hand, when it is more than 20%, the feeling of the final nonwoven fabric is hard and the liquid-permeability or air-permeability of the final nonwoven fabric may degrade for a particular use.

Methods of bonding fibers other than fusion, such as a needle punching method and a water needle method, have problems in that the production speed of the final nonwoven fabric is low and the scale of a production plant is large.

The index of birefrigence (Δn) of raw or used nonwoven fabric is selected to be 0.02 or less. When it exceeds 0.02, filaments tend to break during drawing, so that the operational stability of the nonwoven fabric is poor during drawing. This index of birefrigence is constant before and after the fusion of the nonwoven fabric.

The index of birefrigence of the nonwoven fabric is controllable in the following manner;

Controlling spinning parameters, such as spinning speed, temperature of a spun material and flow rate of an extrusion and/or heat-treating (e.g., heat-setting) a thread control the index of birefrigence.

In detail, the spinning speed is increased during spinning to increase the degree of orientation by drawing, the index of birefrigence is reduced. On the other hand, when the temperature and the flow rate of the extrusion per extruder nozzle are reduced during spinning to increase the drawing stress in a thread, the index of birefrigence is increased.

When the thread is heat treated, the degree of crystallization of the thread is increased to increase the index of birefrigence although the present invention does not require heat treatment.

Uniaxial drawing methods are not restricted. For example, a rolled uniaxial drawing and a tenter type uniaxial drawing can be optionally employed.

When the draw temperature is lower than 80° C., the elongation in a raw fabric is insufficient, so that the raw fabric is broken. On the other hand, when the draw temperature is higher than 130° C., the fibers are approximately fused and the surface of a final nonwoven fabric copies the surface configuration of a drawing roller to be made a film or hardens the feeling of the final nonwoven fabric.

When the draw magnification during drawing is less than 1.5, the strength-increasing effect of the drawing cannot be obtained. This is because a range of the draw magnification of less than 1.5 cannot cause an orientation (rearrangement) of fibers, so that only a part of fibers extending in the direction of the flow of the nonwoven fabric is drawn. On the other hand, when the draw magnification exceeds 2.5, fibers can break.

DETAILED DESCRIPTION OF THE PREFERRED EMBODIMENT(S)

EXAMPLE 1

Polypropylene [IDEMITSU POLYPRO Y6005G (trademark), produced by Idemitsu Petrochemicals Co., Ltd.] was melted and spun to produce a polypropylene longer-fiber having a thread diameter of 25 μm. Subsequently, a web of a METSUKE (unit) weight of 40 g/m$^2$ was made from the polypropylene long-fiber.

Subsequently, the web was thermally embossed at a temperature of 140° C. using an embossing roller to produce an undrawn raw fabric of a compression percentage of 10%. The index of birefrigence of the raw fabric was 0.016 in a measurement using a polarizing microscope.

Subsequently, the undrawn raw fabric was uniaxially drawn at a draw temperature of 80° C. at a draw magnification of 2 using a uniaxial-roller drawing machine to produce a drawn nonwoven fabric of the present EXAMPLE. The METSUKE weight of the drawn nonwoven fabric was 20 g/m$^2$. The thread diameter thereof was 20 μm.

The operational stability of the production of the drawn nonwoven fabric was good. With respect to properties, the thickness of the final nonwoven fabric was uniform. It had neither a nap nor a ravel. The feeling thereof was not hard.

Subsequently, the breaking strength, the breaking elongation and F10 of the final nonwoven fabric of the present EXAMPLE were measured. Table 2 shows the results of the measurements.

The breaking strengths and the breaking elongation in the MD direction and the direction (TD direction) transverse to the MD direction were measured in accordance with JIS L 1096 using an Instron tensile tester. The width of the used test piece was 5 cm.

F10 shows the stress in the final nonwoven fabric when the final nonwoven fabric had an elongation of 10% in the tensile test. Accordingly, the final nonwoven fabric has a greater resistance to elongation during drawing and has a better machinability as F10 increases.

EXAMPLES 2-12

Undrawn raw fabric were produced from polypropylene as a raw material in the same process as EXAMPLE 1. Subsequently, the undrawn raw fabrics were uniaxially drawn to produce drawn nonwoven fabrics for the EXAMPLES.

However, the METSUKE weights of webs, the indices of birefrigence, the draw temperatures and the draw magnifications of undrawn raw fabrics of the EXAMPLES were different as shown in Table 1. Table 1 also shows states during drawing of the raw fabrics.

The breaking strengths, the breaking elongations and F10s of the final nonwoven fabrics of the EXAMPLES were measured in the same manner as EXAMPLE 1. Table 2 shows the results of the measurements. Table 2 also shows the METSUKE weights and the thread diameters of the raw fabrics after drawing.

CONTROLS 1-9

Undrawn raw fabrics were produced from polypropylene as a raw material in the same process as of the EXAMPLES. Subsequently, the undrawn raw fabrics were uniaxially drawn to produce drawn nonwoven fabrics for the CONTROLS.

However, the METSUKE weights of the webs, the indices of birefrigence, the draw temperatures and the draw magnifications of undrawn raw fabrics of the CONTROLS were different as shown in Table 1. Table 1 also shows states during drawing of the raw fabrics.

The breaking strengths, the breaking elongations and F10s of the final nonwoven fabrics of the CONTROLS were measured in the same manner as the EXAMPLES. Table 2 shows the results of the measurements. Table 2 also shows the METSUKE weights and the thread diameters of the raw fabrics after drawing.

TABLE 1

| | | Raw Fabric before Drawing | | | | |
|---|---|---|---|---|---|---|
| | | METSUKE Weight (g/m$^2$) | Index of Birefrigence | Draw Temperature (°C.) | Draw Magnification | State during Drawing |
| EXAMPLE | 1 | 40 | 0.016 | 80 | 2.0 | good |
| | 2 | 30 | 0.016 | 100 | 1.5 | good |
| | 3 | 40 | 0.016 | 100 | 2.0 | good |
| | 4 | 30 | 0.016 | 120 | 1.5 | good |
| | 5 | 40 | 0.016 | 120 | 2.0 | good |
| | 6 | 50 | 0.016 | 120 | 2.5 | good |
| | 7 | 40 | 0.018 | 80 | 2.0 | good |

TABLE 1-continued

| | | Raw Fabric before Drawing | | | | |
|---|---|---|---|---|---|---|
| | | METSUKE Weight ($g/m^2$) | Index of Birefrigence | Draw Temperature (°C.) | Draw Magnification | State during Drawing |
| | 8 | 30 | 0.018 | 100 | 1.5 | good |
| | 9 | 40 | 0.018 | 100 | 2.0 | good |
| | 10 | 40 | 0.018 | 120 | 2.0 | good |
| | 11 | 30 | 0.018 | 120 | 1.5 | good |
| | 12 | 50 | 0.018 | 120 | 2.5 | good |
| CONTROL | 1 | 40 | 0.016 | 60 | 2.0 | Thin part is holed and broken. |
| | 2 | 25 | 0.016 | 100 | 1.25 | good |
| | 3 | 60 | 0.016 | 120 | 3.0 | Thin part is holed and broken. |
| | 4 | 40 | 0.016 | 140 | 2.0 | A winding about a roller occurs. |
| | 5 | 40 | 0.018 | 60 | 2.0 | Thin part is holed and broken. |
| | 6 | 40 | 0.018 | 140 | 2.0 | A winding about a roller occurs. |
| | 7 | 30 | 0.023 | 100 | 1.5 | Thin part is holed and broken. |
| | 8 | 30 | 0.03 | 100 | 1.5 | Thin part is holed and broken. |
| | 9 | 60 | 0.018 | 100 | 3.0 | Thin part is holed and broken. |

TABLE 2

| | | Raw Fabric before Drawing | | Breaking Strength (kg/5 cm) | | Breaking Elongation (%) | | F10 (kg/5 cm) | |
|---|---|---|---|---|---|---|---|---|---|
| | | METSUKE Weight ($g/m^2$) | Thread Diameter (μm) | MD | TD | MD | TD | MD | TD |
| EXAMPLE | 1 | 20 | 20 | 8.5 | 2.0 | 24 | 105 | 6.0 | 0.24 |
| | 2 | 20 | 22 | 4.0 | 1.4 | 24 | 90 | 3.0 | 0.25 |
| | 3 | 20 | 19 | 8.5 | 2.0 | 23 | 120 | 6.0 | 0.25 |
| | 4 | 20 | 23 | 5.3 | 1.2 | 25 | 67 | 3.5 | 0.24 |
| | 5 | 20 | 20 | 9.5 | 2.0 | 21 | 103 | 6.0 | 0.25 |
| | 6 | 20 | 16 | 10.6 | 1.4 | 22 | 107 | 8.0 | 0.26 |
| | 7 | 20 | 22 | 8.5 | 2.5 | 27 | 152 | 5.8 | 0.27 |
| | 8 | 20 | 23 | 7.7 | 2.0 | 22 | 141 | 5.6 | 0.19 |
| | 9 | 20 | 20 | 9.0 | 2.1 | 28 | 137 | 6.3 | 0.21 |
| | 10 | 20 | 21 | 8.4 | 1.7 | 23 | 109 | 5.7 | 0.23 |
| | 11 | 25 | 20 | 8.0 | 2.5 | 25 | 87 | 4.9 | 0.32 |
| | 12 | 20 | 16 | 12.8 | 1.6 | 22 | 105 | 9.6 | 0.25 |
| CONTROL | 1 | 20 | — | — | — | — | — | — | — |
| | 2 | 20 | 25 | 3.2 | 1.6 | 120 | 120 | 2.3 | 0.2 |
| | 3 | 20 | — | — | — | — | — | — | — |
| | 4 | 20 | 23 | 9.4 | 1.8 | 23 | 108 | 7.5 | 0.24 |
| | 5 | 20 | — | — | — | — | — | — | — |
| | 6 | 20 | 23 | 9.6 | 2.0 | 25 | 102 | 6.0 | 0.4 |
| | 7 | 20 | — | — | — | — | — | — | — |
| | 8 | 20 | — | — | — | — | — | — | — |
| | 9 | 20 | — | — | — | — | — | — | — |

STUDY OF EXAMPLES OF THE INVENTION AND CONTROLS

As shown in Tables 1 and 2, since nonwoven fabrics made of polypropylene long-fibers and having the indices of birefrigence of 0.016 and 0.018 were uniaxially drawn at the draw temperatures of 80°–120° C. at the draw magnifications of 1.5–2.5 by the process for producing a nonwoven fabric according to the EXAMPLES of the present invention, the raw fabrics were neither holed nor wound about a roller during drawing, so that an efficient stable drawing was conducted.

The breaking strengths, the breaking elongations and F10s in the directions of MD and TD of each of the final nonwoven fabrics showed good values.

In addition, the final nonwoven fabrics were neither napped nor ravelled in their appearances. They had a superior feeling.

Accordingly, the final nonwoven fabrics produced by the present invention have a superior machinability in that the behaviors of them are stable when a high tension is applied to them in order to increase the speed of the processing machine in the production of the final nonwoven fabrics. Thus, it is understood that the final nonwoven fabrics having stable properties can be obtained.

In CONTROLS 1 and 5 on the other hand, since the indices of birefrigence and the draw magnifications during drawing of the raw nonwoven fabrics are in the ranges of the present invention and the draw temperatures during drawing of the raw nonwoven fabric are lower than the range of the present invention, a thin part of the final nonwoven fabrics was holed and broken during drawing.

In CONTROL 2, since the index of birefrigence and the draw temperature during drawing of the raw nonwoven fabric were in the ranges of the present invention and the draw magnification during drawing of the raw nonwoven fabric was lower than the range of the present invention, the breaking strength, the breaking elongation and F10 of the final nonwoven fabric have problems, although the state of the intermediate nonwoven fabric during drawing is good.

In CONTROLS 3 and 9, since the indices of birefrigence and the draw temperatures during drawing of the raw nonwoven fabrics are in the ranges of the present invention and the draw magnifications during drawing of the raw nonwoven fabric is lower than the range of the present invention, a thin part of the nonwoven fabrics were holed and broken during drawing.

In CONTROLS 4 and 6, since the indices of birefrigence and the draw magnifications during drawing of the raw nonwoven fabrics were in the ranges of the present invention and the draw temperatures during drawing of the raw nonwoven fabrics were higher than the range of the present invention, the nonwoven fabrics were wound about the roller during drawing.

In CONTROLS 7 and 8, since the draw temperatures and the draw magnifications during drawing of the raw nonwoven fabrics were in the ranges of the present invention and the indices of birefrigence during drawing of the raw nonwoven fabric is greater than the range of the present invention, a thin part of the nonwoven fabrics was holed and broken during drawing.

The nonwoven fabric of the superior machinability can be obtained by the process for producing a nonwoven fabric according to the present invention.

What is claimed is:

1. A process for producing a nonwoven fabric by the uniaxially drawing of a web made of continuous long-fibers, said process comprising the steps of:

bonding polypropylene long-fibers making up main fibers of the web to one another at an index of birefrigence of 0.02 or less to produce a raw nonwoven fabric; and uniaxially drawing the nonwoven fabric at a draw temperature of 80°-130° C. and a draw magnification of 1.5-2.5 to produce a final nonwoven fabric.

2. The process for producing a nonwoven fabric as recited in claim 1, wherein a material for the polypropylene long-fibers is homopolypropylene.

3. The process for producing a nonwoven fabric as recited in claim 1, wherein a material for the polypropylene long-fibers is a random copolymer of propylene and α-olefin.

4. The process for producing a nonwoven fabric as recited in claim 1, wherein the polypropylene long-fibers have a thread diameter of from 10-100 μm.

5. The process for producing a nonwoven fabric as recited in claim 1, wherein said polypropylene long-fibers bonding step is conducted by fusion.

6. The process for producing a nonwoven fabric as recited in claim 5, wherein the fusion is conducted by thermal embossing using an embossing roller.

7. The process for producing a nonwoven fabric as recited in claim 6, wherein the thermal embossing is conducted at a temperature of from 120°-150° C.

8. The process for producing a nonwoven fabric as recited in claim 5, wherein the fusion is conducted at a compression percentage of 3-20%.

9. The process for producing a nonwoven fabric as recited in claim 1, wherein indices of birefrigence of the raw and final nonwoven fabrics are 0.02 or less.

10. The process for producing a nonwoven fabric as recited in claim 1, wherein said uniaxial drawing step is conducted by a roller drawing method.

11. The process for producing a nonwoven fabric as recited in claim 1, wherein said uniaxial drawing step is conducted by a center drawing method.

* * * * *

UNITED STATES PATENT AND TRADEMARK OFFICE

CERTIFICATE OF CORRECTION

PATENT NO. : 5,292,389

DATED : March 8, 1994

INVENTOR(S) : Issei Tsuji et al

It is certified that error appears in the above-identified patent and that said Letters Patent is hereby corrected as shown below:

Column 8, line 31; change "center" to ---tenter---.

Signed and Sealed this

Fifth Day of July, 1994

*Attest:*

*Attesting Officer*

BRUCE LEHMAN

*Commissioner of Patents and Trademarks*